United States Patent [19]

Dunphy et al.

[11] Patent Number: 4,724,690

[45] Date of Patent: Feb. 16, 1988

[54] SECURITY BOLT

[75] Inventors: Gerald F. Dunphy, Waverley; Lance E. Best, Vermont South, both of Australia

[73] Assignee: Ogden Industries Pty. Ltd., Huntingdale, Australia

[21] Appl. No.: 899,621

[22] Filed: Aug. 22, 1986

[30] Foreign Application Priority Data

Aug. 22, 1985 [AU] Australia ..... PH2086

[51] Int. Cl.[4] ..... E05B 65/06

[52] U.S. Cl. ..... 70/129; 70/134; 70/100; 70/DIG. 42; 292/153

[58] Field of Search ..... 70/89, 90, 99, 100, 70/124, 129, 134, 181, 386, DIG. 42; 292/145, 153

[56] References Cited

U.S. PATENT DOCUMENTS

| | | | |
|---|---|---|---|
| 3,691,799 | 9/1972 | Hoffmann | 70/DIG. 42 |
| 3,877,261 | 4/1975 | Robins | 70/90 |
| 4,434,634 | 3/1984 | Dunphy | 292/153 |

FOREIGN PATENT DOCUMENTS

| | | | |
|---|---|---|---|
| 543872 | 5/1985 | Australia . | |
| 2624921 | 12/1977 | Fed. Rep. of Germany | 70/386 |

*Primary Examiner*—Robert L. Wolfe

*Attorney, Agent, or Firm*—Berman, Aisenberg & Platt

[57] ABSTRACT

A security bolt including a housing and a bolt rod slidably mounted on that housing for relative movement between operative and inoperative positions. The rod is cylindrical and has a section of reduced diameter between its ends so as to form two opposed shoulders. Key operated locking mechanism, having a rotatable barrel, is attached to the housing and a detent member is rotatably mounted on an end portion of that barrel. The detent member is rotatable to a position at which it engages one of the rod shoulders and thereby prevents movement of the rod out of the operative position. Rotation of the detent member is caused by rotation of the barrel, but a lost motion connection enables the barrel to rotate to a limited extent in either direction without causing corresponding rotation of the detent member. The locking mechanism can be removed from the housing through a rear side and releasable securing means controls that removal. A floating member located between the rod shoulders is arranged to be trapped between one of those shoulders and an opposed surface of the housing so as to prevent separation of the rod from the housing in one direction.

29 Claims, 14 Drawing Figures

SECURITY BOLT

Figure 4:
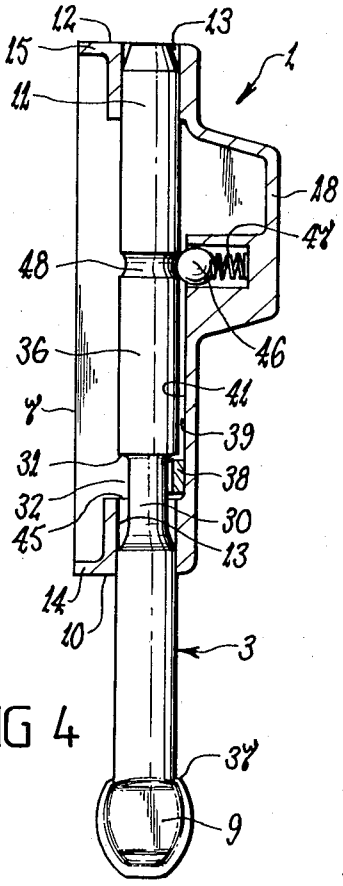

This invention relates to security bolts for doors, windows, and other movable members and is particularly concerned with such bolts which are releasably lockable in an operative position. It will be convenient to hereinafter describe the invention in relation to doors, but it is to be understood that the invention has other applications.

Security bolts of the foregoing kind generally include a rod or bar which is slidably mounted in a member arranged to be secured to an appropriate support. Key operated locking mechanism is operable to releasably secure the rod or bar in a projecting position which is its operative position. An example security bolt of that kind forms the subject of Australian Pat. No. 543,872.

The overall size of a security bolt assembly is usually quite small and as a result there is generally little space within which to mount the locking mechanism. Because of that limitation on space it has usually been the practice to use a disc tumber lock in the mechanism, particularly as such locks can be arranged for 180° movement of the barrel between the locking and release positions. Pin tumbler locks can be similarly arranged, but such locks are usually bulkier than those relying on 360° movement and for that reason are generally not acceptable for use in security bolt assemblies.

Disc tumbler locks are therefore commonly used in security bolt assemblies and the overall security of such assemblies suffers as a result. In that regard, such locks are generally less resistant to picking and other forms of manipulation than are pin tumbler locks. Furthermore, disc tumbler locks usually have a relatively small number of combination codes and consequently there is a greater potential for a lock of that kind to be operated by a key not specifically cut for that lock. Also, most domestic locks are of the pin tumbler kind so that use of a disc tumbler lock in a security bolt assembly disturbs the possibility of having a single key for all locking mechanisms in a particular situation.

In security bolt assemblies, it is desirable to provide means whereby the rod or bar can be releasably retained, independent of the locking mechanism, in either an operative or inoperative position. It is further desirable to provide a means whereby the rod or bar is positively restrained against separation from the associated mounting member. In the construction according to U.S. Pat. No. 543,872, the same element—namely a spring clip—serves each of the foregoing functions and its nature is such that its holding influence can be overcome with relative ease. For example, it is possible to completely withdraw the rod or bar from the mounting member by applying sufficient axial force to cause the spring clip to be deflected out of its holding position.

An object of the present invention is to provide an improved security bolt of the foregoing kind which has a relatively high level of security. In particular, it is an object to provide such a security bolt with locking mechanism which has greater resistance to improper manipulation than prior arrangements of the same general kind. It is another object of the invention to provide such a security bolt which utilises a pin tumbler lock of the kind in which the barrel rotates through 360° between the lock and release positions. Yet another object is to provide such a security bolt which is effective in operation in any of a wide variety of dispositions. It is a further object of the invention to provide such a security bolt having highly effective means for positively retaining the rod or bar against separation from its mounting. Still another object is to provide an arrangement which enables convenient inclusion of effective locking mechanism.

According to one aspect of the present invention, there is provided a security bolt including, a housing, a bolt rod slidably mounted on said housing for movement relative thereto between an operative position and an inoperative position, said rod having an end portion which projects beyond one side of said housing in said operative position and which is substantially contained within said housing in said inoperative position, a detent member mounted on said housing for movement relative thereto between a locking position at which it is operative to prevent movement of said rod from said operative position to said inoperative position and a rest position at which it is not so operative, locking mechanism attached to said housing and including a driving member which is rotatable relative to said housing for movement between locked and unlocked positions, and lost motion means interconnecting said detent and driving members so that the detent member moves between said locking and rest positions in response to part of said driving member movement and does not so move in response to another part of said driving member movement.

According to another aspect of the present invention, there is provided a security bolt including, a housing, a bolt rod slidably mounted on said housing for movement relative thereto between an operative position and an inoperative position, said rod having an end portion which projects beyond one side of said housing in said operative position and which is substantially contained within said housing in said inoperative position, a detent member mounted on said housing for movement relative thereto between a locking position at which it is operative to prevent movement of said rod from said operative position to said inoperative position and a rest position at which it is not so operative, locking mechanism attached to said housing and being operable to releasably secure said detent member against movement out of said locking position, and holding means for preventing axial movement of said rod in one direction beyond a predetermined position so as to thereby prevent separation of said rod from said housing, said holding means including a floating member which is slidably mounted on said housing for movement relative thereto in the axial direction of said rod, and said floating member is arranged for limited movement relative to said rod in the axial direction of the rod and prevents said separation by location between and coaction with opposed surfaces of the rod and the housing respectively.

According to yet another aspect of the invention, there is provided a security bolt including, a housing, a bolt rod slidably mounted in said housing for movement relative thereto between an operative position and an inoperative position, said rod having an end portion which projects beyond one side of said housing in said operative position and which is substantially contained within said housing in said inoperative position, a detent member mounted on said housing for movement relative thereto between a locking position at which it is operative to prevent movement of said rod from said operative position to said inoperative position and a rest position at which it is not so operative, locking mechanism attached to said housing and being operable to releasably secure said detent member against movement out of said locking position, said locking mechanism having a body which is located within a cavity in said housing and is removable from said cavity and said housing through a rear side of said housing, and a barrel which is mounted on said body for rotation about an axis extending transverse to the longitudinal axis of said rod, said cavity is located to one side of said rod and said body is movable into and out of said cavity in the general direction of said barrel rotational axis, means interconnecting said detent member and said barrel whereby said detent member moves in response to said barrel rotation, and securing means interacting between said housing and said body to releasably hold said body against removal from said housing.

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 3:
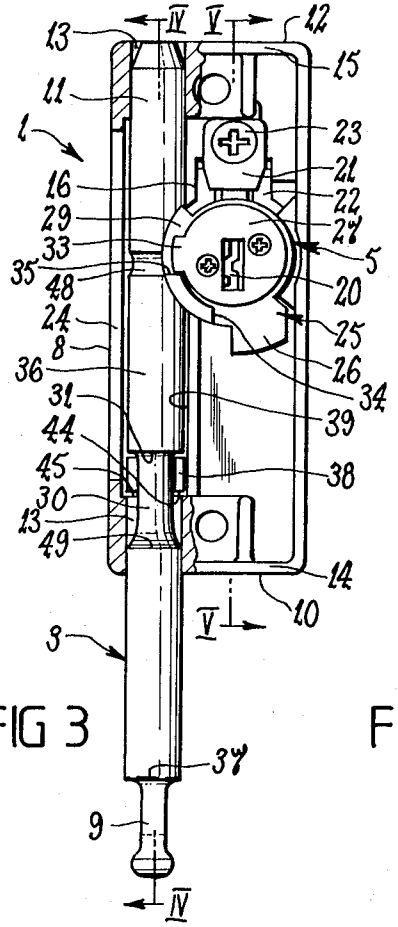
Figure 2:
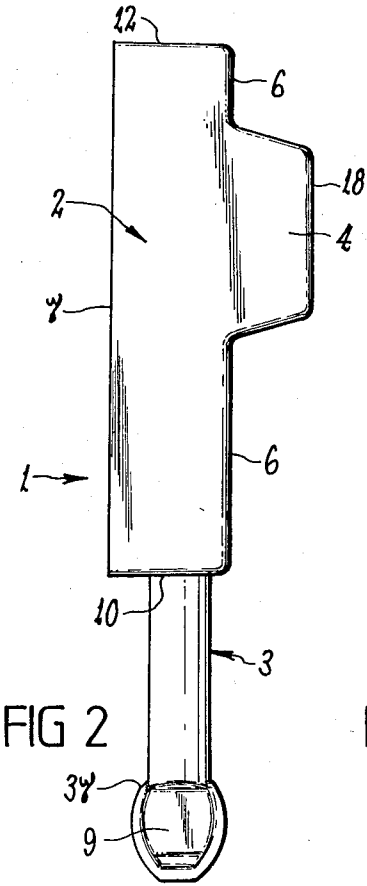
Figure 1:
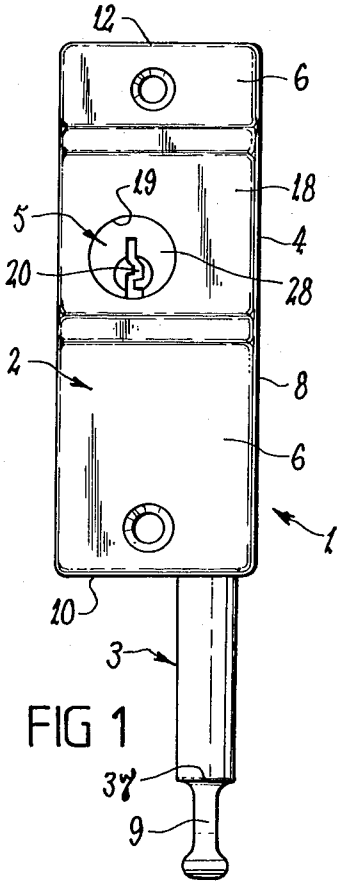
Figure 9:
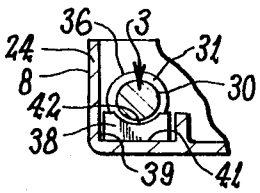
Figure 8:
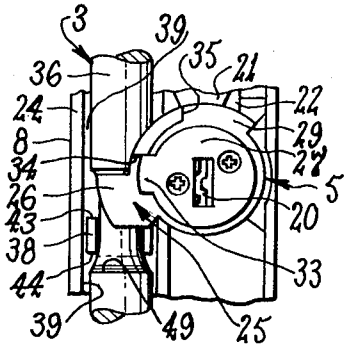
Figure 7:
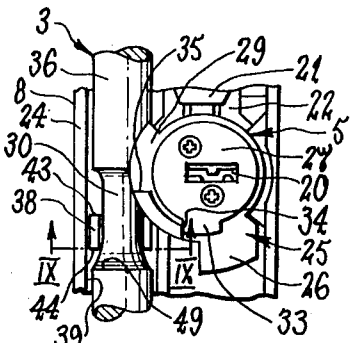
Figure 6:
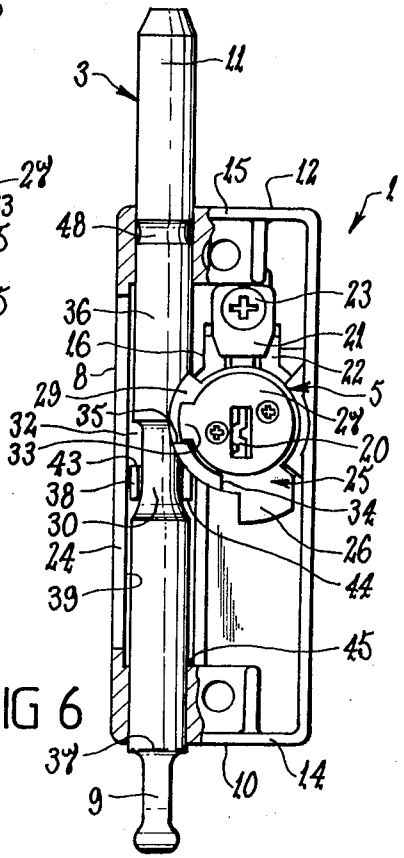
Figure 5:
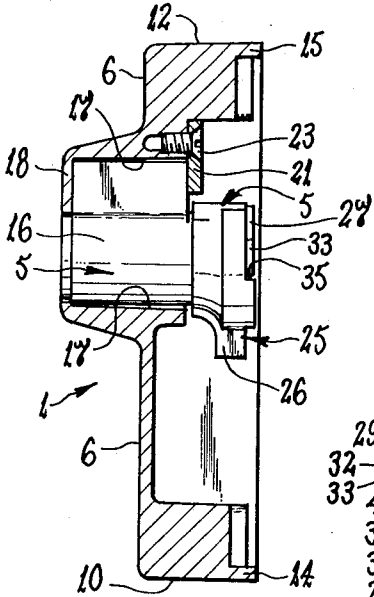
Figure 10:
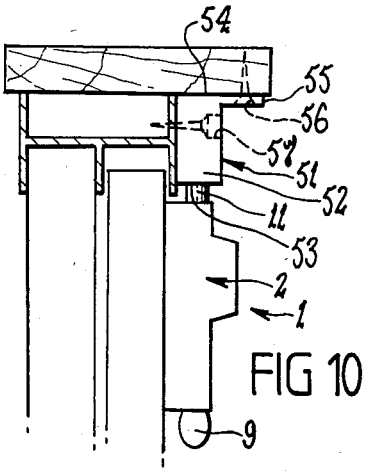

In the drawings:

FIG. 1 is a front elevation view of a security bolt according to one embodiment of the invention, FIG. 2 is a side elevation view of the security bolt shown in FIG. 1, FIG. 3 is a rear elevation view of the security bolt shown in FIG. 1, with parts being sectioned for convenience of illustration, FIG. 4 is a cross-sectional view taken along line IV—IV of FIG. 3, FIG. 5 is a cross-sectional view taken along line V—V of FIG. 3, FIG. 6 is a view similar to FIG. 3 but showing the bolt in an operative condition, FIG. 7 is a view of part of the construction shown in FIG. 6 but showing the lock mechanism turned through 270° to a position at which it is operable to thereafter prevent withdrawal of the lock bolt to an inoperative position, FIG. 8 is a view similar to FIG. 7 but showing the lock mechanism turned through a further 90° so as to positively prevent withdrawal of the lock bolt to an inoperative position, FIG. 9 is a cross-sectional view taken along line IX—IX of FIG. 7, FIGS. 10 to 14 are semi-diagrammatic views which show various arrangements in which the security bolt can be used.

In an example arrangement shown in the drawings, the security bolt 1 includes a housing 2 which is adapted to be secured to a door, door surround, or other support, and a rod 3 of circular cross-section which is slidably mounted on the housing 2 and forms the actual bolt. The housing 2 can be of any suitable shape, but in the form shown it is an elongate member of substantially rectangular shape in transverse cross-section and having an enlarged section 4 intermediate its ends for containing the locking mechansm 5. That enlarged section 4 projects outwardly for a suitable distance beyond a front surface 6 of the remainder of the housing 2. It is preferred that the housing 2 is hollow and open at a back surface 7 to enable access to the interior.

The bolt rod 3 is preferably slidably mounted in the housing 2 so as to project longitudinally thereof adjacent one side 8 of the housing 2. A finger engageable part 9 of the rod 3 is arranged to project beyond one end 10 of the housing 2 in both operative and inoperative positions of the rod 3 (FIGS. 6 and 3 respectively). A strike engaging end portion 11 of the rod 3 opposite the finger engageable part 9 projects beyond the other end 12 of the housing 2 in the operative position of the rod 3 (FIG. 6) and is at least substantially withdrawn into the housing 2 in the inoperative position (FIG. 3). The slidable mounting for the rod 3 may include, as shown, a cylindrical bore 13 of appropriate diameter formed through each of two opposite end walls 14 and 15 of the housing 2.

Locking mechanism 5 for the rod 3 may be of any suitable form but in the embodiment shown includes a key operated pin tumbler cylinder lock. The lock cylinder or body 16 is locatable within a suitably shaped cavity 17 (FIG. 5) accessible at the rear of the housing 2 so as to be properly positioned relative to the rod 3. That is, at least part of the cavity 17 may cooperate with the lock body 16 so that the body 16 can have one position only relative to the housing 2. It is preferred that the lock body 16 is simply slid axially into the housing cavity 17 from the rear of the housing and abuts with say the front wall 18 of the housing 2 so as to fix its endwise position. An opening 19 (FIG. 5) formed through the front wall 18 of the enlarged housing section 4 provides means whereby a key can be inserted into the lock keyway 20 (FIG. 1).

Withdrawal of the lock body 16 through the rear of the housing 2 may be prevented by securing means which includes a plate 21 or the like which overlies a rearwardly facing shoulder or surface 22 (FIG. 3) of the lock body 16 and is releasably secured to the housing 2 by a screw 23 or other suitable fastening means. The cavity 17 is located so that the lock 5 is positioned to one side of the bolt rod 3 as shown in FIG. 1. That is, the rod 3 is located between the lock body 16 and the side wall 24 of the housing 2.

Any suitable means may be provided whereby the lock 5 can cooperate with the bolt rod 3 so as to prevent withdrawal of the rod 3 from its operative position. In the particular arrangement shown that means includes a detent member 25 which is rotatably mounted on a rear end portion of the lock body 16 and which has a laterally projecting section 26 adapted to be engageable with the rod 3. A driving member 27 secured to the rear end of the lock barrel 28 (FIG. 1) so as to be rotatable therewith, is operable to hold the detent member 25 in a locking position as hereinafter described. That driving member 27 may also serve to hold the detent member 25 in assembly with the lock body 16 by overlying a rearwardly facing surface 29 (FIG. 3) of the detent member 25.

It is preferred, as shown, that the bolt rod 3 is provided with a section 30 of reduced diameter at a location between its ends so as to provide means for cooperating with the detent projecting section 26 which will be hereinafter referred to as the detent finger 26. The shoulder 31 formed at the end of the reduced section 30 adjacent the strike engaging end portion 11 of the rod 3 forms a stop surface 31 for engagement with the detent finger 26 and that stop surface 31 may be substantially at right angles relative to the longitudinal axis of the bolt 3. When the detent member 25 is in its locking position (FIG. 8), the finger 26 protrudes into the groove 32 formed by the reduced section 30 and engages with the cooperable stop surface 31.

The driving member 27 of the lock 5 may have a laterally projecting lug 33, as shown, which engages against an abutment surface 34 of the detent member 25 when both the lock 5 and the detent member 25 are in their respective locking positions (FIG. 8). Assuming there is no key in the lock 5, the barrel 28 will be held against rotation by the tumbler pins (not shown) and the lug 33 and abutment surface 34 engage in such a way that the driving member 27 holds the detent member 25 against rotation away from the engaging stop surface 31 of the rod 3. It therefore follows that the rod 3 cannot be moved from the operative position (FIG. 6) towards the inoperative position (FIG. 3) and the restraint against that movement is of a substantial nature such that forced movement of the bolt rod 3 is not possible without shearing the tumbler pins of the lock 5.

When it is desired to release the lock 5 so that the rod 3 can be retracted from the operative position, the lock 5 is operated by the appropriate key so that the barrel 28 is rotated in a direction such as to turn the lug 33 away (anti-clockwise in FIG. 8) from the cooperating abutment surface 34 of the detent member 25. If the lock 5 is of a kind requiring 360° movement of the barrel 28 between locking and unlocking positions, the driving and detent members 27 and 25 may be relatively arranged to allow an appropriate amount of relative rotation between those members 27 and 25. In the example shown, the driving member 27 is capable of substantially 270° degree rotation from the position shown in FIG. 8 before the lug 33 engages another abutment surface 35 of the detent member 25. Continued rotation of the driving member 27 then causes corresponding rotation of the detent member 25 so that the detent finger 26 is moved out of the path of the rod 3 (FIGS. 3 and 6) and the rod 3 is freed for movement into its inoperative position.

It will be appreciated that rotation of the lock barrel 28 in the direction opposite (i.e., clockwise) to that last described will cause the driving member 27 to move the detent member 25 back into its locking position (see FIG. 7). Such movement is not possible, however, unless the rod 3 is in or near its operative position because the detent member 25 would otherwise foul with the larger diameter section 36 of the rod 3.

Movement of the rod 3 beyond its operative position may be prevented by a part 37 of the finger engageable portion 9 engaging the adjacent end 10 of the housing 2. Movement in the reverse direction beyond the inoperative position is prevented by holding means which positively holds the bolt 3 against complete separation from the housing 2. In the preferred arrangement shown, that holding means includes a floating member 38 which is located within the housing 2 so as to be movable relative thereto in the axial direction of the rod 3. The member 38 may be of block-like form and located within a guide groove 39 provided within the housing 2 between the front wall section 40 (FIG. 4) thereof and the rod 3. It is preferred, but not essential, that the base 41 (Figure 4) of the guide groove 39 is close to the surface of the large diameter section 36 of the rod 3.

The floating member 38 may have a groove 42 (FIG. 9) extending in the axial direction of the rod 3 so as to receive the reduced diameter section 30 of the rod 3. In the assembled condition of the security bolt 1 the floating member 38 is located between the ends of that reduced diameter section 30 and is captured between that section 30 and the opposed base 41 of the guide groove 39. The floating member 38 has a length less than that of the reduced diameter section 30 of the rod 3. The arrangement is such that when the rod 3 is retracted towards its inoperative position the stop surface 31 engages the adjacent end 43 of the floating member 38 and thereby pushes that member 38 along the guide groove 39 toward the end 10 of the housing 2. At the inoperative position of the rod 3 the opposite end 44 of the floating member 38 engages an opposed surface 45 (FIG. 4) of the housing 2 and thereby positively holds the bolt rod 3 against further travel away from the operative position.

The floating member 38 does not hinder movement of the rod 3 from the inoperative to the operative position because of its sliding location within the groove 39. When the rod 3 is moved from the FIG. 4 position towards the FIG. 6 position, the shoulder 49 of the rod 3 engages the end 44 of the member 38 and thereby pushes the member 38 towards the position shown for that member 38 in FIG. 6.

It is preferred that the floating member 38 is captured against removal from the guide groove 39 when the security bolt 3 is fully assembled. In the arrangement shown, it may be moved laterally into and out of that groove 39 through an access opening (not shown) when the lock body 16 is removed from the housing 2, but other arrangements could be adopted to achieve the same result.

Retaining means for releasably holding the bolt rod 3 in its operative and inoperative positions independent of the lock mechanism 5, preferably includes a spring influenced ball detent, as shown in FIG. 4. That ball 46 and its associated spring 47 may be mounted on the housing 2 at a location adjacent the lock mechanism 5 and in such a way that the ball 46 is movable in a direction transverse to the axis of the bolt rod 3. At the inoperative position of the rod 3 the ball 46 may engage within a circumferential groove 48 provided around the rod 3 and in the operative position of the rod 3 the ball 46 preferably engages behind the stop surface 31. The arrangement is such that the rod 3 cannot be moved from either the inoperative or operative position without directly applying an axial force to the rod 3. In particular, the rod 3 will not be dislodged from either of those positions by vibration, gravitation forces, or other incidental forces to which the rod 3 may be subjected in use.

A security bolt as described can be used in a wide variety of circumstances, some of which are shown by FIGS. 10 to 14 of the attached drawings.

Figure 11:
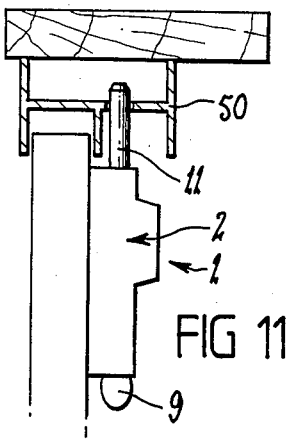
Figure 12:
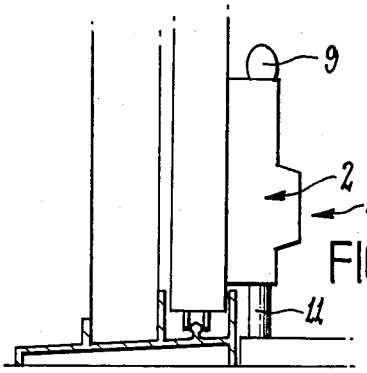
Figure 13:
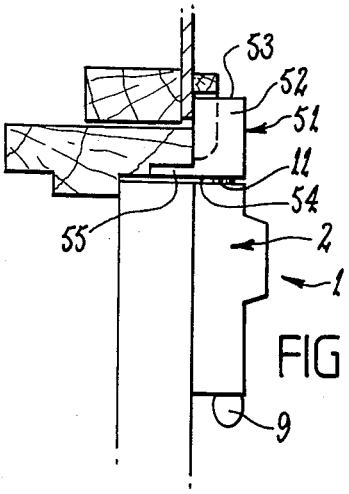
Figure 14:
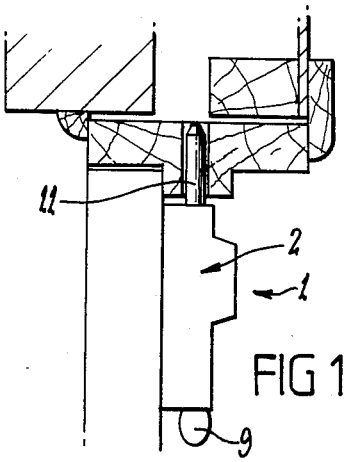

Any suitable form of strike can be used with the security bolt. In some cases, as shown by FIGS. 11, 12 and 14, the strike may be formed by an integral part of a structure with which the bolt is used—e.g., a door surround 50 (FIG. 11) having a bore to receive the rod end portion 11. In other cases, such as those shown by FIGS. 10 and 13, a special strike 51 may be secured to the relevant structure.

The particular strike 51 as shown includes a block-like member 52 having a bore (not shown) extending at least partway therethrough for receiving the strike engaging end portion 11 of the rod 3. Preferably, the bore extends completely through opposite ends 53 and 54 of the member 52. A mounting flange 55 having at least one hole 56 therethrough projects laterally from one end of the member 52. At least one further mounting hole 57 may be formed through the block-like member 52 in a direction transverse to the bore and located to one side of that bore.

It will be apparent from the foregoing description that the security bolt of the present invention will be particularly effective in use regardless of its disposition.

It is also relevant that the bolt rod cannot be removed from its housing unless the security bolt is completely dismantled.

Various alterations, modifications and/or additions may be introduced into constructions and arrangements of parts previously described without departing from the spirit or ambit of the invention as defined by the appended claims.

Having now described our invention, what we claim as new and desire to secure by Letters Patent is:

1. A security bolt including, a housing, a bolt rod slidably mounted on said housing for movement relative thereto between an operative position and an inoperative position, said rod having an end portion which projects beyond one side of said housing in said operative position and which is substantially contained within said housing in said inoperative position, a detent member mounted on said housing for movement relative thereto between a locking position at which it is operative to prevent movement of said rod from said operative position to said inoperative position and a rest position at which it is not so operative, locking mechanism attached to said housing and being operable to releasably secure said detent member against movement out of said locking position, and holding means for preventing axial movement of said rod in one direction beyond a predetermined position so as to thereby prevent separation of said rod from said housing, said holding means including a floating member which is slidably mounted on said housing for movement relative thereto in the axial direction of said rod, and said floating member is arranged for limited movement relative to said rod in the axial direction of the rod and prevents said separation by location between and coaction with opposed surfaces of the rod and the housing respectively.

2. A security bolt according to claim 1, wherein said floating member is interposed between a section of said rod and a wall of said housing, said rod section is located between two opposed shoulders of the rod which are spaced apart in the axial direction of the rod, one said shoulder forms the said rod surface, and said floating member is located between said shoulders and has a length in the axial direction of said rod which is less than the axial separation of said shoulders so that said relative movement between the rod and the floating member is limited by said floating member engaging with one or the other of said shoulders.

3. A security bolt according to claim 2, wherein said floating member is slidably mounted in a guide groove provided in said housing.

4. A security bolt according to claim 2, wherein said rod section is cylindrical and said floating member has a part cylindrical groove formed therein which is substantially complementary to the cylindrical shape of the rod section and which receives part of that rod section.

5. A security bolt according to claim 4, wherein said locking mechanism is removable from said housing, said floating member is trapped against removal from its location between said rod and said housing wall while said locking mechanism is in place, and said removal of the locking mechanism exposes an access opening through which said floating member can be removed from said housing.

6. A security bolt according to claim 1, wherein said detent member engages with said rod surface to prevent movement of said rod out of said operative position.

7. A security bolt including, a housing, a bolt rod slidably mounted in said housing for movement relative thereto between an operative position and an inoperative position said rod having an end portion which projects beyond one side of said housing in said operative position and which is substantially contained within said housing in said inoperative position, a detent member mounted on said housing for movement relative thereto between a locking position at which it is operative to prevent movement of said rod from said operative position to said inoperative position and a rest position at which it is not so operative, locking mechanism attached to said housing and being operable to releasably secure said detent member against movement out of said locking position, said locking mechanism having a body which is located within a cavity in said housing and is removable from said cavity and said housing through a rear side of said housing, and a barrel which is mounted on said body for rotation about an axis extending transverse to the longitudinal axis of said rod, said cavity is located to one side of said rod and said body is movable into and out of said cavity in the general direction of said barrel rotational axis, means interconnecting said detent member and said barrel whereby said detent member moves in response to said barrel rotation, and securing means interacting between said housing and said body to releasably hold said body against removal from said housing.

8. A security bolt according to claim 7, wherein said securing means includes a plate which is releasably secured to said housing by a fastening screw and which overlies part of a rearwardly facing surface of said body.

9. A securing bolt including, a housing, a bolt rod slidably mounted on said housing for movement relative thereto between an operative position and an inoperative position, said rod having an end portion which projects beyone one side of said housing in said operative position and which is substantially contained within said housing in said inoperative position, a detent member mounted on said housing for movement relative thereto between a locking position at which it is operative to prevent movement of said rod from said operative position to said inoperative position and a rest position at which it is not so operative, locking mechanism attached to said housing and including a rotatable barrel, key releasable tumblers which are operative to prevent rotation of said barrel relative to said housing, and a driving member connected to said barrel for rotation therewith, said barrel and said driving member being rotatable relative to said housing for movement between locked and unlocked positions, lost motion means interconnecting said detent and driving members so that the detent member moves between said locking and rest positions in response to part of said driving movement and does not so move in response to another part of said driving member movement, said detent member is mounted on an end portion of said barrel for rotation relative thereto, said lost motion means functions to limit the extent of said relative rotation, a shoulder is formed on said rod, said shoulder extends substantially transverse to the longitudinal axis of said rod and faces away from said end portion of the rod, said detent member has a laterally projecting section which is engageable with said shoulder when said detent member is in said locking position, said driving member is operable to prevent rotation of said detent member away from said locking position, said lost motion means includes two abutment surfaces provided on said detent member and a laterally projecting lug provided on said driving member, a space exists between said abutment surfaces and said lug is located within and is movable through that space so as to engage either of said abutment surfaces according to the direction of rotation of said driving member, and the relative sizes of said space and said lug are such that said driving member is able to rotate through a substantial distance without engaging a said abutment surface and thereby causing corresponding rotation of the detent member.

10. A security bolt according to claim 9, wherein stop means is operative to prevent said rod moving relative to said housing beyond said operative position thereof.

11. A security bolt according to claim 9, wherein retaining means releasably holds said rod in said operative position independent of the influence of said detent member on said rod.

12. A security bolt according to claim 11, wherein said retaining means releasably holds said rod in said inoperative position.

13. A security bolt according to claim 11, wherein said retaining means includes a ball mounted on said housing for movement relative thereto, a spring urging said ball towards a rod engaging position, and a recess in said rod within which said ball engages when the rod is in said operative position.

14. A security bolt according to claim 9, wherein said driving member is removably connected to said barrel and overlies part of said detent member so as to restrain said detent member against separation from said barrel.

15. A security bolt according to claim 9, wherein said barrel is rotatably mounted on an axis which is laterally spaced from said longituidinal axis of the rod.

16. A security bolt according to claim 15, wherein said locking mechanism includes a body, said barrel is rotatably mounted in said body, said body is slidably located in a cavity formed in said housing and is removable from said cavity and said housing through a rear side of said housing, and securing means operates to releasably hold said body against movement relative to said housing.

17. A security bolt according to claim 16, wherein said securing means includes a securing plate which is removably attached to said housing and which overlies a rearwardly facing surface of said body.

18. A security bolt according to claim 16, wherein said body is of non-circular shape in cross-section transverse to the rotational axis of said barrel, and said cavity has a substantially complementary cross-sectional shape.

19. A security bolt according to claim 9, further including holding means for preventing axial movement of said rod in one direction beyond a predetermined position so as to thereby prevent separation of said rod from said housing, said holding means including a floating member which is slidably mounted on said housing for movement relative thereto in the axial direction of said rod, and said floating member is arranged for limited movement relative to said rod in the axial direction of the rod and prevents said separation by location between and coaction with opposed surfaces of the rod and the housing respectively.

20. A security bolt including, a housing, a bolt rod slidably mounted on said housing for movement relative thereto between an operative position and an inoperative position, said rod having an end portion which projects beyond one side of said housing in said operative position and which is substantially contained within said housing in said inoperative position, a detent member mounted on said housing for movement relative thereto between a locking position at which it is operative to prevent movement of said rod from said operative position to said inoperative position and a rest position at which it is not so operative, locking mechanism attached to said housing and including a rotatable barrel, key releasable tumblers which are operative to prevent rotation of said barrel relative to said housing, and a driving member connected to said barrel for rotation therewith, said barrel and said driving member being rotatable relative to said housing for movement between locked and unlocked positions, lost motion means interconnecting said detent and driving members so that the detent member moves between said locking and rest positions in response to part of said driving member movement and does not so move in response to another part of said driving member movement, said detent member is removably mounted on an end portion of said barrel for rotation relative thereto, and overlies part of said detent member so as to restrain said detent member against separation from said barrel, and said lost motion means functions to limit the extent of said relative rotation.

21. A security bolt according to claim 20, wherein a shoulder is formed on said rod, said shoulder extends substantially transverse to the longitudinal axis of said rod and faces away from said end portion of the rod, said detent member has a laterally projecting section which is engageable with said shoulder when said detent member is in said locking position, and said driving member is operable to prevent rotation of said detent member away from said locking position.

22. A security bolt according to claim 21, wherein said lost motion means includes two abutment surfaces provided on said detent member and a laterally projecting lug provided on said driving member, a space exists between said abutment surfaces and said lug is located within and is movable through that space so as to engage either of said abutment surfaces according to the direction of rotation of said driving member, and the relative sizes of said space and said lug are such that said driving member is able to rotate through a substantial distance without engaging a said abutment surface and thereby causing corresponding rotation of the detent member.

23. A security bolt according to claim 20, wherein said driving member rotates through substantially 360° between said locked and unlocked positions, and said detent member rotates through substantially 90° between said locking and rest positions.

24. A security bolt according to claim 20, wherein a detent member is rotatable relative to said housing, a shoulder is formed on said rod and is engaged by said detent member when that member is in said locking position, and said driving member is operable to prevent rotation of said detent member away from said locking position.

25. A security bolt according to claim 24, wherein said rod is of circular shape in transverse cross-section, said shoulder is formed at one end of a reduced diameter section of said rod, and retaining means is engageable with said shoulder to releasably hold said rod in said operative position independent of the influence of said detent member.

26. A security bolt according to claim 25, wherein holding means is mounted within said housing for movement relative thereto in the axial direction of said rod, said holding means is engageable with said shoulder and with part of said housing to prevent movement of said rod in one direction away from said inoperative position, and stop means is operative to prevent movement of said rod in the direction opposite to said one direction away from said inoperative position.

27. A security bolt according to claim 26, wherein said stop means includes a finger engageable portion of said rod which is located externally of said housing at a side thereof opposite said one side and which is engageable with an external surface of said housing.

28. A security bolt according to claim 24, wherein said detent and driving members are rotatable about a common axis which extends substantially transverse to the longitudinal axis of said rod and is laterally spaced from said longitudinal axis.

29. A security bolt including, a housing, a bolt rod slidably mounted on said housing for movement relative thereto between an operative position and an inoperative position, said rod having an end portion which projects beyond one side of said housing in said operative position and which is substantially contained within said housing in said inoperative position, a detent member mounted on said housing for movement relative thereto between a locking position at which it is operative to prevent movement of said rod from said operative position to said inoperative position and a rest position at which it is not so operative, locking mechanism attached to said housing and including a rotatable barrel, key releasable tumblers which are operative to prevent rotation of said barrel relative to said housing, and a driving member connected to said barrel for rotation therewith, said barrel and said driving member being rotatable relative to said housing for movement between locked and unlocked positions, lost motion means interconnecting said detent and driving members so that the detent member moves between said locking and rest positions in response to part of said driving member movement and does not so move in response to another part of said driving member movement, said barrel is rotatably mounted on an axis extending transverse to the longitudinal axis of said rod and which is laterally spaced from said longitudinal axis, said locking mechanism includes a body, said barrel is rotatably mounted in said body, said body is slidably located in a cavity formed in said housing and is removable from said cavity and said housing through a rear side of said housing, and securing means operates to releasably hold said body against movement relative to said housing.

* * * * *